US005749522A

United States Patent [19]

Smrt

[11] Patent Number: 5,749,522

[45] Date of Patent: May 12, 1998

[54] MARKING DEVICE WITH DISTANCE MEASURING CAPABILITY

[76] Inventor: Thomas J. Smrt, 9716 S. Grant Hwy., Marengo, Ill. 60152

[21] Appl. No.: 622,036

[22] Filed: Mar. 21, 1996

[51] Int. Cl.[6] ..... B67D 5/08

[52] U.S. Cl. ..... 239/71; 239/150; 239/754; 33/781; 33/782

[58] Field of Search ..... 239/150, 151, 239/289, 754, 71; 222/611.1; 280/DIG. 5; 180/6.5, 19.1, 19.2; 33/772, 775, 779, 780, 781, 782

[56] References Cited

U.S. PATENT DOCUMENTS

| | | | |
|---|---|---|---|
| 2,595,021 | 4/1952 | Swanson | 33/781 |
| 3,673,693 | 7/1972 | Evans, Jr. | 33/781 |
| 4,895,304 | 1/1990 | Smrt | 239/150 |
| 4,989,342 | 2/1991 | Nosek | 33/782 X |
| 5,003,704 | 4/1991 | Schubert | 33/772 X |

FOREIGN PATENT DOCUMENTS

| | | | |
|---|---|---|---|
| 1185529 | 3/1970 | United Kingdom | 33/782 |

*Primary Examiner*—Andres Kashnikow
*Assistant Examiner*—Steven J. Ganey
*Attorney, Agent, or Firm*—Leydig, Voit & Mayer,Ltd.

[57] ABSTRACT

A device for discharging the contents of an aerosol container onto a surface which allows an operator to determine the distance the device travels when moved relative to the surface is provided. The device includes a housing having a structure for holding an aerosol container. The aerosol container having an actuator mounted on the container that moves between discharging and non-discharging positions. The device further includes an actuating assembly which effects movement of the aerosol container actuator between the discharging and non-discharging positions and a trigger disposed on the device that controls the actuating assembly and which allows an operator to discharge the contents of the aerosol container onto a surface. The device has at least one rotatable wheel disposed on the housing which rotates as the device is moved relative to the surface and a lever-actuated counter disposed on the device for counting the number of revolutions of the at least one wheel thereby allowing an operator to determine the distance the device has traveled when moved relative to the surface.

6 Claims, 5 Drawing Sheets

MARKING DEVICE WITH DISTANCE MEASURING CAPABILITY

FIELD OF THE INVENTION

This invention generally relates to devices for discharging the contents of aerosol containers and, more particularly, to an aerosol container discharging device that is capable of measuring the distance the device has traveled over a surface.

BACKGROUND OF THE INVENTION

The use of aerosol containers for dispensing marking compositions is well-known, e.g., for marking or striping parking lots, construction sites, sporting fields, and factory floors. Often, the marks or stripes must extend a certain predetermined distance. This is typically accomplished by using a measuring device, such as a tape measure, to determine the end point of the stripe or mark before the marking composition is actually applied onto a surface.

A number of devices have been developed for use with aerosol containers which allow a person making such marks or stripes to remain relatively upright, while at the same time the container is positioned relatively close to the surface to be marked. These devices further allow the discharge of the marking compositions from the container to be controlled by the user. Examples of these types of devices are provided by U.S. Pat. Nos. 4,895,304, 5,148,988, 5,368,202 and 5,518,148.

While the foregoing devices solve many of the problems associated with marking surfaces using aerosol containers, they do not solve the problems associated with making marks or stripes which must extend only a predetermined distance. More particularly, and by way of example, when one desires to make a stripe or mark of a certain length, it is necessary for the operator to first perform the step of marking the start and end points of each mark or stripe, and then apply the marking composition onto the surface. The time-consuming nature of this procedure is particularly pronounced when one desires to apply a number of marks or stripes to a surface, e.g., lines on a parking lot, wherein the number of measurements that must be made before the actual marking is completed has a significant detrimental affect on the operator's efficiency.

Accordingly, a need exists for a device which overcomes the foregoing problems.

SUMMARY OF THE INVENTION

The present invention satisfies the aforesaid need by providing a device for discharging the contents of an aerosol container onto a surface, wherein the device allows an operator to determine the distance the device travels when moved relative to the surface while the aerosol container in the device is being discharged. The device comprises a housing; means disposed on the housing for holding an aerosol container having an actuator mounted on the container that moves between discharging and non-discharging positions; actuating means which effects movement of the aerosol container actuator between the discharging and non-discharging positions; means disposed on the device for controlling the actuating means which allows an operator to discharge the contents of the aerosol container onto the surface; at least one rotatable wheel disposed on the housing which rotates as the device is moved relative to the surface; and means disposed on the device for counting the number of revolutions of the at least one wheel which allows an operator to determine the distance the device has traveled when moved relative to the surface.

These and other features and advantages of the invention will be more readily apparent upon reading the following description of preferred embodiments of the invention and upon reference to the accompanying drawings.

While the present invention will be described and disclosed in connection with certain preferred embodiments and methods, it is not intended that the invention be limited to those specific embodiments. Rather, it is intended that the present invention cover all such alternative embodiments and modifications that fall within the spirit and scope of the present invention.

DETAILED DESCRIPTION OF THE PREFERRED EMBODIMENTS

In accordance with one embodiment of the present invention, there is provided a device for discharging the contents of an aerosol container onto a surface, wherein the operator is able to determine the distance the device travels when moved relative to the surface while the container is being discharged.

Figure 1:
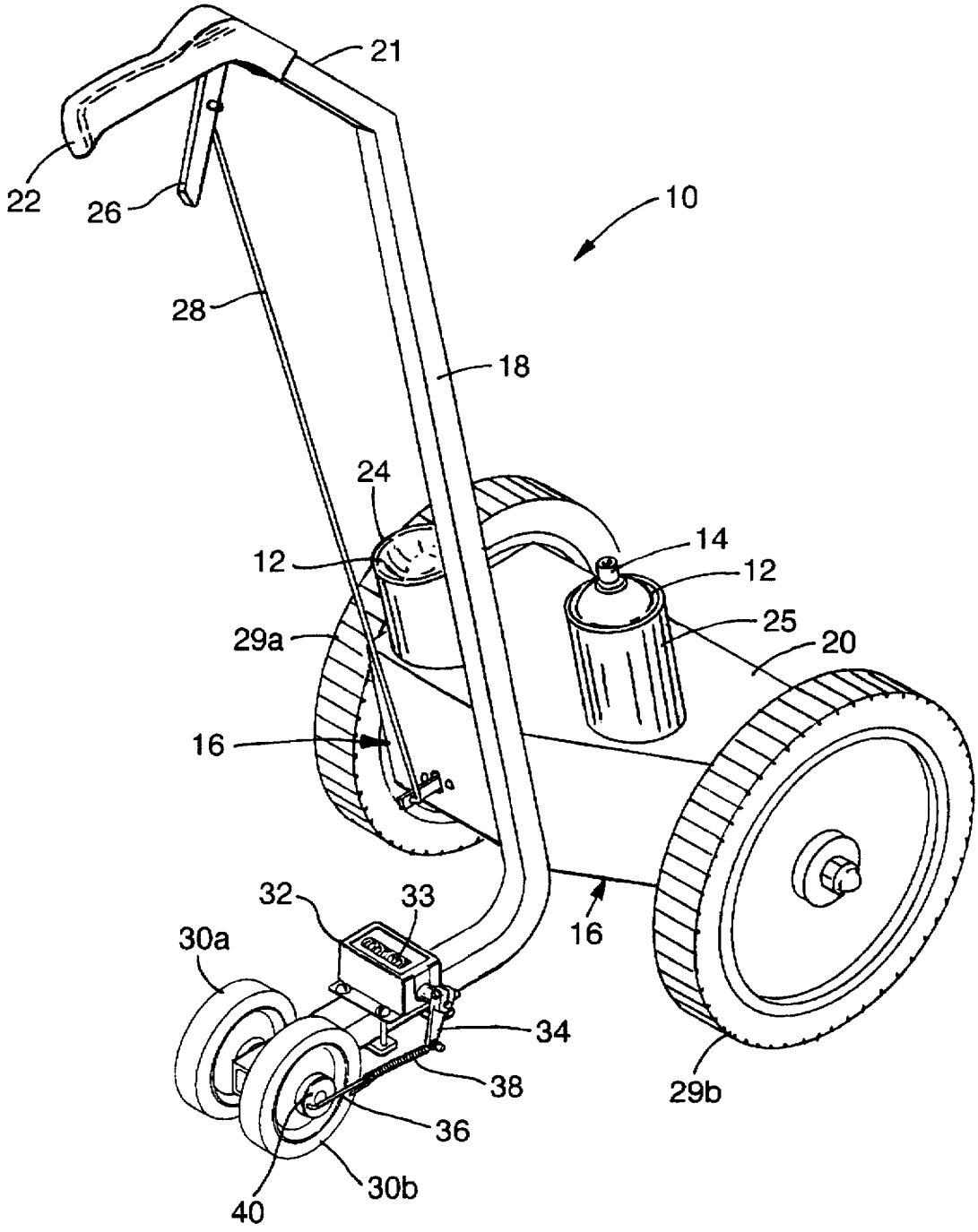
FIG. 1 is a perspective view of an aerosol container discharging device that is capable of measuring the distance that the device has traveled on a surface in accordance with one embodiment of the present invention.

Turning initially to FIG. 1, there is illustrated one preferred embodiment of the device 10 of the present invention shown in use with a conventional aerosol container 12 designed to be discharged in the inverted position. The aerosol container 12 includes an actuator 14 mounted thereon that moves between discharging and non-discharging positions, thereby controlling the discharge of the contents of the aerosol container 12.

The device 10 includes a housing 16 on or within which the various components of the device are disposed. In the embodiment illustrated in FIGS. 1-3, the housing 16 comprises a relatively hollow body portion 20 to which is attached a handle 18. A handle grip 22 for manual grasping by the user of the device is disposed at the top end 21 of the handle 18. Means for receiving and holding an aerosol container 12 is disposed on the body portion 20 of the housing 16. In the illustrated embodiment of FIGS. 1–3, the container holding means comprises a generally cylindrical structure 24 which is sized to receive an inverted aerosol container. Within the container holder 24 is an annular flange (not shown) adapted to engage a ridge portion on the aerosol container thereby properly positioning and retaining the aerosol container within the cylindrical structure 24. As is well known, the flange should be located on the container holder 24 so the actuator is located at a distance from the surface so that the desired mark or stripe is provided thereon.

This positioning, of course, can be varied to provide for the results desired, as will be appreciated by those skilled in the art. The body portion 18 of the housing 16 may optionally include a second container holding structure 25 which, if used, can hold a full or empty aerosol container.

The device 10 also includes an actuating means which moves the aerosol container actuator between discharging and non-discharging positions. In the embodiment shown in FIG. 1, the actuating means comprises an actuator rod 28 that is mounted on the device and is movable relative to the aerosol container disposed in the aerosol container holder 24. In this way, the actuating means can be moved between a discharging position, wherein the actuator means effects movement of the aerosol container actuator into the discharging position, and a non-discharging position wherein the actuator is not moved into the discharging position.

In the case of the aerosol containers used with the embodiments disclosed herein, when an operator desires to mark a surface, the actuating means must displace the actuator sideways, thus opening the spring-biased valve of the container and providing for discharge of the marking composition from the container. When the actuating means is retracted, the actuator will return to its former position and the spring-biased valve will re-close, halting the discharge.

The device 10 further includes means for controlling the movement of the actuating means, and thereby the aerosol container actuator between the discharging and non-discharging positions. As exemplified in FIG. 1, the control means comprises a triggering mechanism which includes a spring-biased trigger 26 that is disposed adjacent the top end 21 of the handle 18 near the handle grip 22. The trigger 26 is attached to and controls the movement of an actuating means, which in the embodiment illustrated in FIGS. 1–3 comprises a trigger rod 28.

Figure 3:
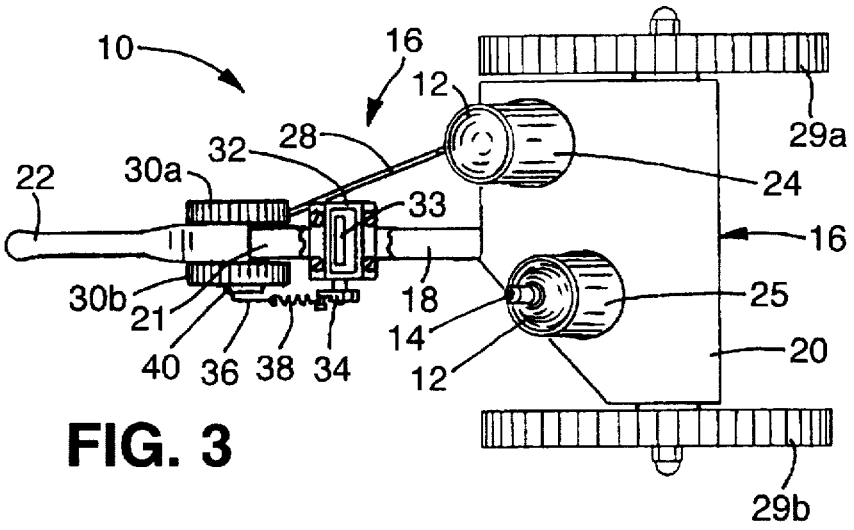
FIG. 3 is a top view of the discharging device of FIG. 1.
Figure 2:
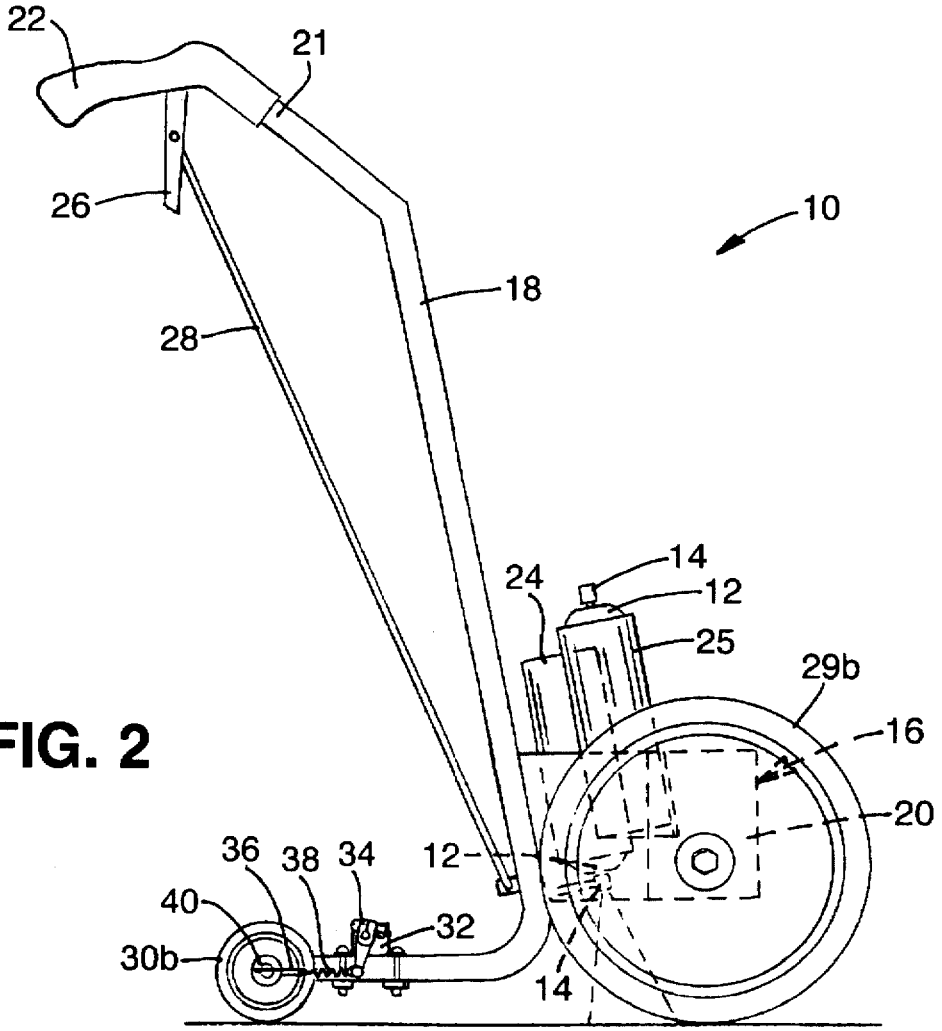
FIG. 2 is a side view of the discharging device of FIG. 1.

In the specific embodiment illustrated in FIGS. 1–3, the movement of the container actuator described previously is provided by an actuator rod 28. This rod 28 is bent in such a way so that upon movement of the spring-biased trigger 26, the rod will move upward and away from the container and in doing so contact the actuator and cause it to move sideways, this is turn causing the container valve to be opened. Upon release of the trigger 26, the actuator rod 28 moves downward and toward the container, allowing the actuator to assume its normal position, which in turn allows the container valve to close.

As will be appreciated by one of ordinary skill, there are a number of component configurations by which the container actuator can be displaced, and any of those can be used in the embodiments disclosed and claimed herein.

The device further comprises at least one wheel which is disposed on the device. As exemplified in FIGS. 1–3, the device includes four wheels, two of which **29*a*, 29*b* are rotatably mounted to the body portion 20 of the housing 16 and two of which 30*a*, 30*b* are rotatably mounted to the lower end of the handle 18. The wheels 30*a*, 30*b*** allow the user to easily move the device over a surface while maintaining the aerosol container actuator at a particular, desired distance from the surface.

Figure 4:
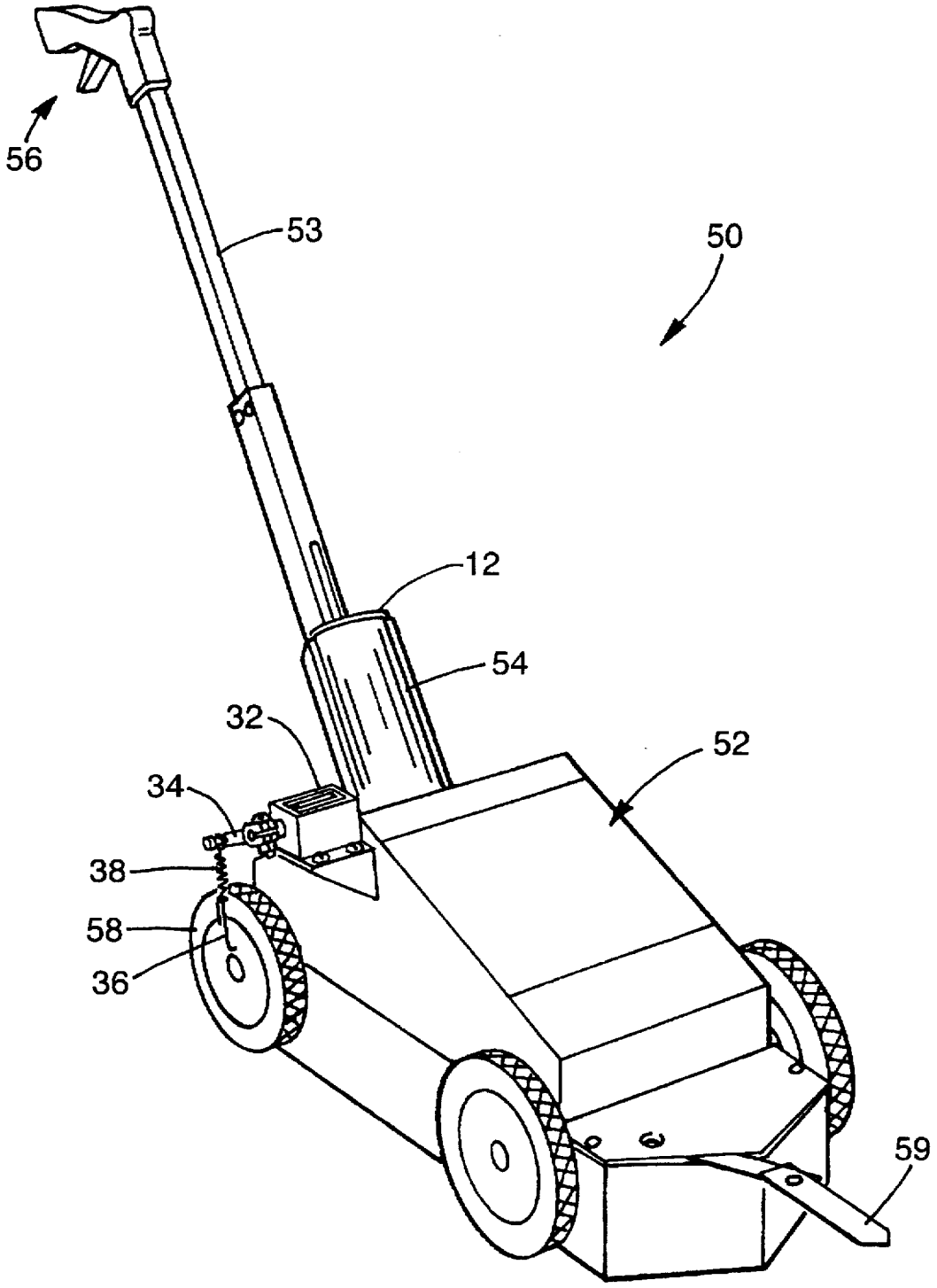
FIG. 4 is a perspective view of another embodiment of an aerosol container discharging device of the present invention.

While the embodiment illustrated in FIGS. 1–3 has four wheels, those skilled in the art will appreciate that the present invention is equally applicable to aerosol container discharging devices having at least one wheel (e.g., FIG. 5), at least two wheels, at least three wheels, and other embodiments having at least four wheels (e.g., FIG. 4).

In accordance with one important aspect of the present invention, the device further includes a means disposed on the device for counting the number of revolutions of the at least one rotatable wheel which allows an operator to determine the distance the device has traveled when moved relative to the surface. Any type of device that is able to count or provide a display of the distance the device travels over the surface can be used to provide the outcome desired, however, simple mechanical devices are believed to be the devices of choice because they are economical and reliable. In one embodiment of the device, as best depicted in FIG. 1A, the counting means comprises a mechanical counter 32.

The counting means may be activated by any suitable means, so long as the counting means is activated as the device travels over the surface being marked. By way of example only, the counting means may be in mechanical or electromechanical connection with a wheel which rotates as the device travels over the surface. As will be well appreciated by those skilled in the art, this wheel may ride directly on the surface over which the device travels, or may be rotated directly or indirectly by a wheel that rides directly on the surface. The counting means may be actuated by physical movement of the connection in the case of a mechanical connection, or by electromechanical triggering, e.g., by a component of the wheel passing through a light beam emitted by the counting means, thereby triggering the counting means.

Figure 1A:
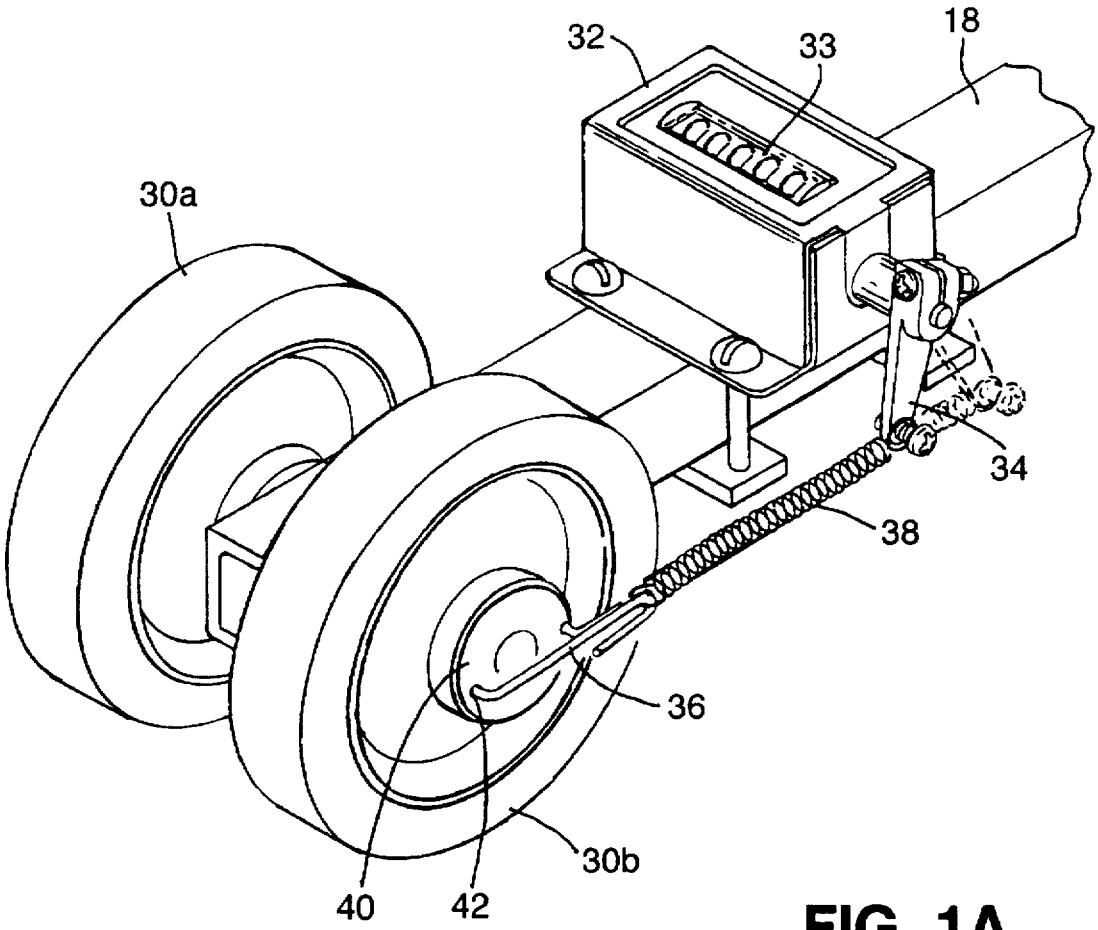
FIG. 1A is a partial enlarged view of the discharging device of FIG. 1 showing a preferred counter which records the revolutions of one wheel of the device.

By way of example, and with respect to the embodiment shown in FIG. 1A, the counter 32 is mounted on the lower end of the handle 18. The counter 32 is actuatable and, in addition, is adapted to record the number of times that it has been actuated. The counter 32 further includes a display 33 which enables the user of the device to observe how many times the counter 32 has been actuated and, as will be described in more detail below, how far the device has been moved relative to a surface.

The counter 32 of FIG. 1A is actuated by movement of a lever arm 34 that is pivotally attached to the counter 32 such that it can move the between actuated and non-actuated positions. More specifically, movement of the lever arm 34 from the non-actuated position to the actuated position causes the counter 32 to actuate, thereby adding one to the number of actuations recorded.

In the embodiment of FIG. 1A, the connection between the wheel and counter is provided by a lever arm 34 that is attached to the hub portion 40 of one wheel **30*b* by a wire 36 and a spring 38. As illustrated, one end of the wire 36 is attached to the wheel hub 40 via a hole 42 which is provided in the hub 40. The opposite or second end of the wire 36 is attached to one end of a spring 38, the second end of which, in turn, is attached to the lever arm 34. In this embodiment of the invention, the end of the wire 36 that is attached to the wheel hub 40 has a generally zigzag configuration (not shown) that helps to retain the wire 36 in the hole 42 during use of the device 10**. Those skilled in the art will appreciate that other methods may be used to retain the wire in the hole in the hub.

The interaction of the foregoing preferred components can be best understood by reference to FIG. 1A. In that embodiment, as the wheel **30*b* rotates in the clockwise direction, the hole 42 within which the wire 36 is mounted moves relative to the counter 32. As the hole 42 moves from the 3 o'clock position, which corresponds to the non-actuated position of the lever arm 34 (shown in broken lines), to the 9 o'clock position, which corresponds to actuated position of the lever arm 34 (shown in solid lines), the hole 42 moves farther away from the counter 32, thereby tensioning the spring 38 and pulling the lever arm 34** towards the wheel 30b. This movement of the lever arm 34 from the non-actuated to the actuated position actuates the counter 32. As the hole 42 moves in the clockwise direction from the 9o'clock position to the 3 o'clock position, the bias of the spring 38 causes the lever arm 34 to move from the actuated position back into the non-actuated position, causing the counter to advance by one. In this particular embodiment, movement of the lever arm 34 from the actuated to the non-actuated position does not actuate the counter 32.

The counter 32 can optionally include reset means which would allow the user, as desired, to reset the number of actuations of the counter 32 to zero. Further, the counting means may be mounted in any suitable location on the device, e.g., the housing, so long as the counting means is activated by the movement of the device.

When the user of the device wishes to create a mark or stripe on a surface that extends only a certain predetermined distance, the user need only move the device while discharging the contents of the aerosol container until the counter reaches the desired number. One way in which the counter can be used to record the number of feet or meters that the device has been moved is by attaching the lever arm device to a wheel in a position so that, for each foot or meter traveled by the device, the counter will be activated.

Figure 5:
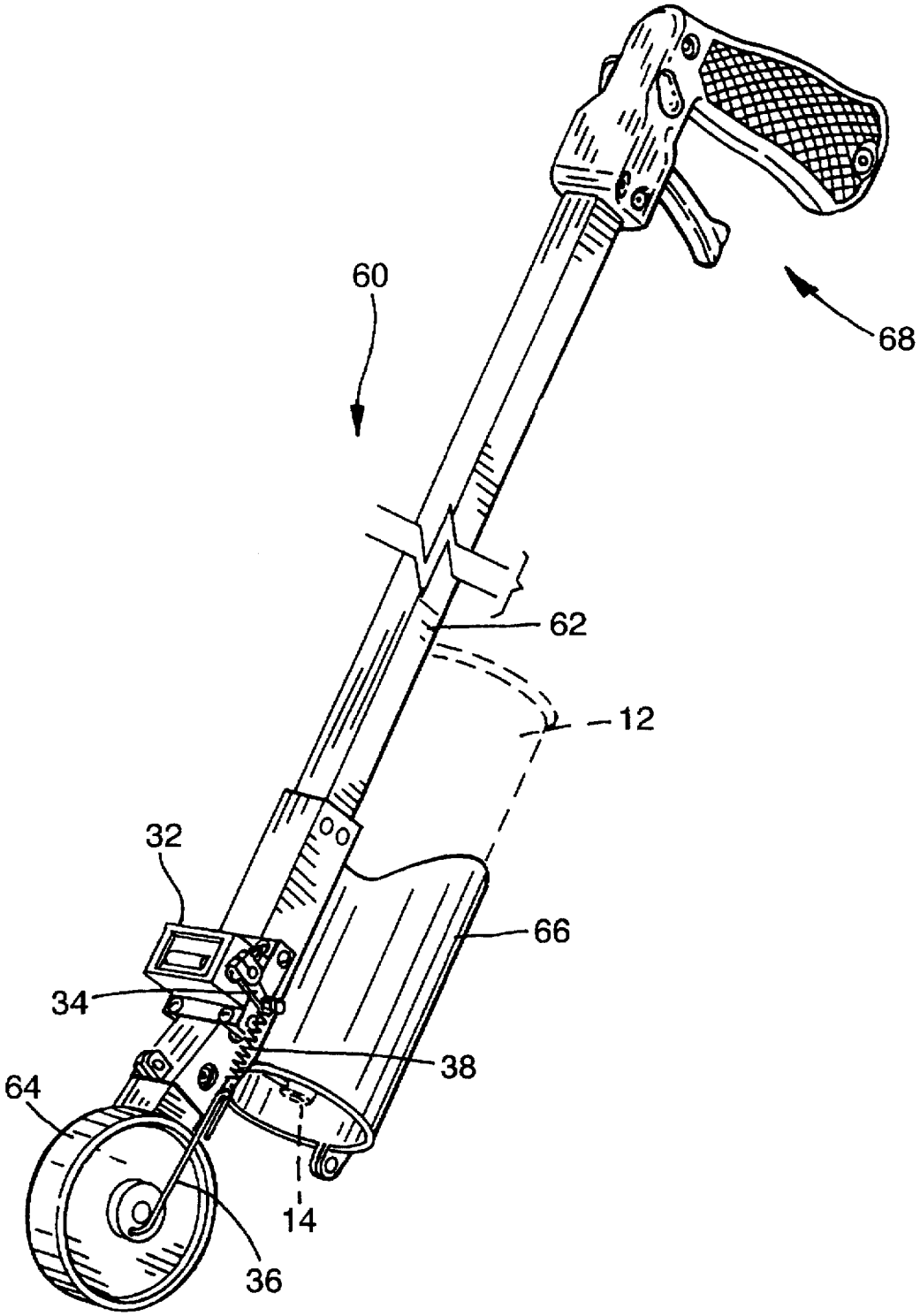
FIG. 5 is a perspective view of yet another embodiment of an aerosol container discharging device of the present invention.

FIGS. 4 and 5 illustrate two alternative embodiments of the device of the present invention. More particularly, FIGS. 4 and 5 illustrate how the present invention can be adapted and used successfully with other aerosol container discharging devices. FIG. 4 illustrates an aerosol container discharging device 50 that includes a housing 52 having a container holder 54 mounted thereon, actuating means (not shown), a trigger mechanism 56, a handle 53, and four attached wheels 58. The embodiment illustrated in FIG. 4 optionally includes a pointer 59 which can be used by the operator as an aid moving the device along a desired path. FIG. 5 illustrates an aerosol container discharging device 60 that includes an elongated housing 62 having only one attached wheel 64, a container holder 66, actuating means (not shown), and a triggering mechanism 68.

While the components of the foregoing devices which allow a user to control the discharge of the aerosol container held at a remote distance from the user have been described herein in connection with certain preferred embodiments, those skilled in the art will appreciate that the present invention is equally applicable to other aerosol container discharging devices.

All of the references cited herein, including patents, patent applications, and publications, are hereby incorporated in their entireties by reference.

While the present invention has been described with an emphasis upon preferred embodiments, it will be obvious to those of ordinary skill in the art that variations of the preferred embodiments disclosed herein may be used and that it is intended that the invention may be practiced otherwise than as specifically described herein. Accordingly, this invention includes all modifications encompassed within the spirit and the scope of the invention as defined by the following claims.

What is claimed is:

1. A device for discharging the contents of an aerosol container onto a surface which allows an operator to determine the distance the device travels when moved relative to the surface, the device comprising:

a housing;

means disposed on the housing for holding an aerosol container, wherein the container has an actuator mounted on the container that moves between discharging and non-discharging positions;

actuating means which effects movement of the aerosol container actuator between the discharging and non-discharging positions;

means disposed on the device for controlling the actuating means which allows an operator to discharge the contents of the aerosol container onto the surface;

at least one rotatable wheel disposed on the device which contacts the surface and rotates as the device is moved relative to the surface;

a counter disposed on the device for counting the number of revolutions of the at least one wheel;

a lever arm attached to the counter which moves between non-actuated and actuated positions thereby actuating the counter; and a linkage having a second end attached to the lever arm and a first end attached directly to the at least one wheel such that rotation of the wheel moves the lever arm between the actuated and non-actuated positions thereby actuating the counter and allowing an operator to determine the distance the device has traveled.

2. The device of claim 1, wherein the linkage comprises a wire having said first linkage end and a second end and a spring having, a first end and said second linkage end, wherein the first linkage end of the wire is attached to the at least one wheel, the second end of the wire is attached to the end of the spring, and the second linkage end of the spring is attached to the lever arm.

3. The device of claim 1, wherein the device comprises at least two wheels.

4. The device of claim 3, wherein the device comprises at least three wheels.

5. The device of claim 4, wherein the device comprises at least four wheels.

6. The device of claim 1, wherein the counter includes a display which shows the number of times the counter has been actuated.

* * * * *